US007357270B2

(12) United States Patent
Mayrose

(10) Patent No.: US 7,357,270 B2
(45) Date of Patent: Apr. 15, 2008

(54) CONTAINER HOLDER AND A SYSTEM FOR SUPPORTING CONTAINERS AND A METHOD FOR HOLDING CONTAINERS

(75) Inventor: Tom Mayrose, Golden Valley, MN (US)

(73) Assignee: Mayrose Enterprises, Inc, Golden Valley, MN (US)

( * ) Notice: Subject to any disclaimer, the term of this patent is extended or adjusted under 35 U.S.C. 154(b) by 163 days.

(21) Appl. No.: 10/650,550

(22) Filed: Aug. 28, 2003

(65) Prior Publication Data

US 2005/0045648 A1 Mar. 3, 2005

(51) Int. Cl.
*B65D 21/02* (2006.01)

(52) U.S. Cl. ..... 220/23.86; 248/346.1; 248/346.11; 220/737

(58) Field of Classification Search ..... 220/9.4, 220/9.1, 737, 475; 206/427, 557; D7/701; 248/346.1, 346.11, 346.5; 211/74
See application file for complete search history.

(56) References Cited

U.S. PATENT DOCUMENTS

| | | | | | |
|---|---|---|---|---|---|
| D161,572 | S | * | 1/1951 | Davis | D6/616 |
| 2,746,571 | A | * | 5/1956 | Taylor | 188/32 |
| 3,570,680 | A | | 3/1971 | Klassen et al. | 211/49 |
| 3,746,179 | A | * | 7/1973 | Paumgardhen | 211/75 |
| 3,870,156 | A | | 3/1975 | O'Neill | 211/74 |
| 4,122,947 | A | * | 10/1978 | Falla | 206/569 |
| D250,625 | S | | 12/1978 | Leventhal | D6/188 |
| 4,327,836 | A | * | 5/1982 | Okuno | 211/74 |
| 4,606,465 | A | | 8/1986 | Moustakas | 211/43 |
| 4,660,727 | A | | 4/1987 | Levine | 211/74 |
| 4,802,705 | A | * | 2/1989 | Elwell | 296/39.2 |
| D313,711 | S | | 1/1991 | Levine | D6/469 |
| 4,998,631 | A | | 3/1991 | Fridjhon | 211/74 |
| 5,035,013 | A | * | 7/1991 | Bloom | 5/420 |
| 5,088,139 | A | * | 2/1992 | Bloom | 5/420 |
| 5,128,189 | A | * | 7/1992 | Bartlett | 428/71 |
| 5,180,066 | A | | 1/1993 | McArdle | 211/74 |
| 5,308,670 | A | * | 5/1994 | Saylor | 428/81 |
| D351,535 | S | * | 10/1994 | Renegar | D7/701 |
| D353,747 | S | | 12/1994 | Lanier | D7/701 |
| D365,732 | S | | 1/1996 | Kellen et al. | D7/701 |
| 5,535,461 | A | * | 7/1996 | Schwender | 5/420 |
| D395,210 | S | | 6/1998 | Almsig | D7/701 |
| D396,783 | S | | 8/1998 | Lee | D7/701 |
| 5,826,731 | A | | 10/1998 | Dardashti | 211/74 |
| 5,947,305 | A | | 9/1999 | Lin | 211/74 |
| 6,081,927 | A | * | 7/2000 | Gimbel | 2/161.7 |
| 6,120,876 | A | * | 9/2000 | Walton | 428/137 |

(Continued)

FOREIGN PATENT DOCUMENTS

| | | | | |
|---|---|---|---|---|
| GB | 2154860 | A | * | 9/1985 |

*Primary Examiner*—Stephen J. Castellano
(74) *Attorney, Agent, or Firm*—Patents & TMS, P.C.

(57) ABSTRACT

A container holder, a system for supporting containers and a method for holding containers which allow the containers to be stored and/or displayed are provided. Additionally, the container holder may have a base or arm connected to a first stopper and/or a second stopper. Further, the length of the base may adjust to accommodate a varying number of the containers. Still further, the container holder may accommodate containers having different shapes and sizes. The weight of the containers on the base hold the containers on the base connected between the first stopper and the second stopper.

10 Claims, 5 Drawing Sheets

U.S. PATENT DOCUMENTS

D433,660 S * 11/2000 Hough ..... D12/217
D446,092 S 8/2001 Cautereels ..... D7/701
6,454,108 B1 * 9/2002 Gerard ..... 211/74
6,779,665 B2 * 8/2004 Bolanos ..... 206/569
2002/0066708 A1 6/2002 Gerard
2003/0039788 A1 * 2/2003 Harris ..... 428/40.1

* cited by examiner

CONTAINER HOLDER AND A SYSTEM FOR SUPPORTING CONTAINERS AND A METHOD FOR HOLDING CONTAINERS

BACKGROUND OF THE INVENTION

The present invention generally relates to a container holder. More specifically, the present invention relates to a container holder for storing and/or displaying more than one container. The containers may be cylindrical, such as, for example, wine bottles, water bottles and/or cans of soda, vegetables or the like. Further, the container holder may store and/or display the containers on a surface such as, for example, a counter, a cupboard, a shelf, a table, a flat surface and/or the like. The container holder may have a base attached to a holding stopper attached and looped around a removable stopper. Still further, the containers may be held between the holding stopper and the removable stopper. Moreover, the weight of containers on the base may hold the holding stopper in a fixed position with respect to the removable stopper.

It is generally known to provide a storage rack for containers, such as, for example, wine bottles, champagne bottles and/or soda cans. A storage rack is typically used to store containers in, for example, homes, restaurants, and/or bars. Additionally, a storage rack is used to display the containers for purposes, such as, for example, advertising and/or vending at, for example, stores, bars and/or restaurants. Traditionally, a storage rack is made from a material, such as, for example, wood, iron, brass and/or the like. Other materials, such as, for example, rubber, plastic and glass, have been used in a storage rack. Further, a storage rack typically is a structure having a solid frame with a fixed length, a fixed width and a fixed height. Moreover, a storage rack is often large and, therefore, requires a significant space. Thus, the use of a storage rack may be limited because a large space may not be available.

Moreover, a storage rack having a solid frame is not collapsible to provide simplified storing and/or transporting of the same. Furthermore, a storage rack typically has openings to receive containers of a specific size and shape, such as, for example, wine bottles. Additionally, most storage racks have openings that limit the storing of containers to those having identical sizes and/or shapes as the openings. Further, the number of openings is a fixed number, such as, for example, six and is not adjustable to store a different number of containers, such as, for example, ten.

A need, therefore, exists for an adjustable container holder which may store containers, such as, for example, wine bottles, water bottles and/or cans of soda, vegetables or the like. Further, a need exists for a method and a system for storing containers with an adjustable container holder which may have a frame allowing for adjustment to hold any number of containers. Still further, a need exists for a method and a system for storing containers with an adjustable container holder which may store containers of various shapes and/or sizes at the same time. Moreover, a need exists for a method and a system for storing containers with an adjustable container holder which may be collapsible to provide for storing and/or transporting of the same.

SUMMARY OF THE INVENTION

A container holder may receive and/or hold a container. The container may be cylindrically shaped, such as, for example, a champagne bottle, a water bottle, vegetable can and/or the like. Further, the length of the container holder may be changed to receive and/or hold different numbers of containers, such as, for example, thirteen wine bottles and/or twelve vegetable cans in a row and/or stacked upon each other. Moreover, the container holder may receive and/or may hold containers having different shapes and sizes at the same time, such as, for example, soda bottles and beer bottles and/or the like.

The container holder may have a base attached to a holding stopper. Further, the base may be, for example, a rectangular sheet of material, such as, for example, a fabric and/or the like. In a preferred embodiment, the shape of the base may be rectangular; however, it should be understood that a base of any size or shape may be implemented by one skilled in the art. The base may have a first end and a second end opposite to the first end which may extend away from the holding stopper and loop around a removable stopper. Furthermore, the second end of the flexible base may extend towards the holding stopper and overlap a portion of the base which connects the holding stopper to the removable stopper.

Moreover, the holding stopper and/or the removable stopper may be, for example, a tube and may be made from a material, such as, for example, steel, plastic, wood and/or the like. The holding stopper and the removable stopper may form a first side and a second side, respectively, of the container holder. Further, a surface, such as, for example, a wall, a cupboard and/or a surface of a refrigerator may form the second side of the container holder instead of the removable stopper. The containers may be placed on the base between the holding stopper and the removable stopper. The weight of the containers on the base may hold the holding stopper and the removable stopper in a fixed position with respect to each other. Moreover, the containers may be held between the holding stopper and the removable stopper and/or the surface on the base of the container holder.

To this end, in an embodiment of the present invention, a container holder for supporting a plurality of containers wherein the container holder is positioned on a surface is provided. The container holder has a first stopper defined by peripheral walls between a first end and a second end. The container also has a base having a planar surface defined between a first end and a second end wherein the planar surface of the base is adjacent to the surface and further wherein the first stopper is connected to the base. Further, the container has a support element adjacent to the surface wherein the second end of the base is associated with the support element and further wherein the base extends between the first stopper and the support element.

In an embodiment, the support element is a second stopper having peripheral walls between a first end and a second end.

In an embodiment, the container holder has stitching connecting the first end of the base to the first stopper.

In an embodiment, the container holder has a hoop at the first end of the base wherein the first stopper is inserted into the hoop.

In an embodiment, the support element is a nonparallel surface with respect to the surface.

In an embodiment, the base wraps around the support element.

In an embodiment, the container holder has a loop at the second end of the base wherein the support element is inserted into the loop.

In an embodiment, the base has a length greater than a length of the first stopper.

In an embodiment, the container holder has a scale attached to the planar surface of the base wherein the scale is related to the plurality of containers.

In an embodiment, the container holder has an auxiliary device associated with the first stopper wherein the auxiliary device cooperates with one of the plurality of containers.

In another embodiment of the present invention, a method for holding a plurality of containers on a surface is provided. The method has the steps of placing a stopper on the surface and positioning a base on the surface wherein the base has a length defined between a first end and a second end wherein the first end is connected to the stopper. Further, the method has the step of positioning a support element at a point near the second end wherein the support element is adjustable based on a number of the plurality of containers and further wherein the stopper abuts against one of the plurality of containers and the support element abuts against another one of the plurality of containers.

In an embodiment, the method has a step of attaching the first end of the base to the stopper. In an embodiment, the method has a step of overlapping the base around the support element. In an embodiment, the method has a step of attaching the second edge of the base to the support element.

In an embodiment, the method has a step of dividing the length of the base into a scale related to the plurality of containers.

In another embodiment of the present invention, a system for supporting a plurality of containers on a surface is provided. The system has a stopper having a length defined between a first end and a second end and an arm having a length defined between a first end and a second end wherein the first end of the arm is attached to the stopper such that the length of the arm extends substantially perpendicular to the length of the stopper.

In an embodiment, the system has a support element associated with the second end of the arm wherein one of the plurality of containers abut the stopper and another one of the plurality of containers abut the support element.

In an embodiment, the system has a scale associated with the length of the arm wherein the scale is related to the plurality of containers.

In an embodiment, the system has indicia associated with the arm.

In an embodiment, the system has an auxiliary device associated with the stopper.

It is, therefore, an advantage of the present invention to provide a container holder, a system for supporting containers and a method for holding containers which allows a length of the container holder to be varied. Another advantage of the present invention is to provide a container holder, a system for supporting containers and a method for holding containers which stores and/or displays containers of different shapes and sizes.

And, another advantage of the present invention is to provide a container holder, a system for supporting containers and a method for holding containers which allows a number of containers held by the adjustable container holder to be varied.

Yet another advantage of the present invention is to provide a container holder, a system for supporting containers and a method for holding containers which allows containers to be stacked on top of one another and/or aligned in a row.

A further advantage of the present invention is to provide a container holder, a system for supporting containers and a method for holding containers which provides a bottle opener.

A still further advantage of the present invention is to provide a container holder, a system for supporting containers and a method for holding containers which provides a cork.

Moreover, an advantage of the present invention is to provide a container holder, a system for supporting containers and a method for holding containers which is positioned on a surface to hold containers.

And, another advantage of the present invention is to provide a container holder, a system for supporting containers and a method for holding containers which couples with a surface to provide support for containers held by the container holder.

Yet another advantage of the present invention is to provide a container holder, a system for supporting containers and a method for holding containers which provides printed and/or screened indicia.

Another advantage of the present invention is to provide a container holder, a system for supporting containers and a method for holding containers which collapses to provide space efficient storing and/or transporting.

Yet another advantage of the present invention is to provide a container holder, a system for supporting containers and a method for holding containers which provides an efficient use of space to store containers.

A still further advantage of the present invention is to provide a container holder, a system for supporting containers and a method for holding containers which provides a decorative display to hold containers.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a container holder, a system for supporting containers and a method for holding containers which may store and/or display containers. To this end, the container holder, the system and the method may allow the containers, such as, for example, wine bottles, cans, water bottles and/or the like to be stacked on top of one another to provide for storing and/or displaying of the same.

Figure 1:
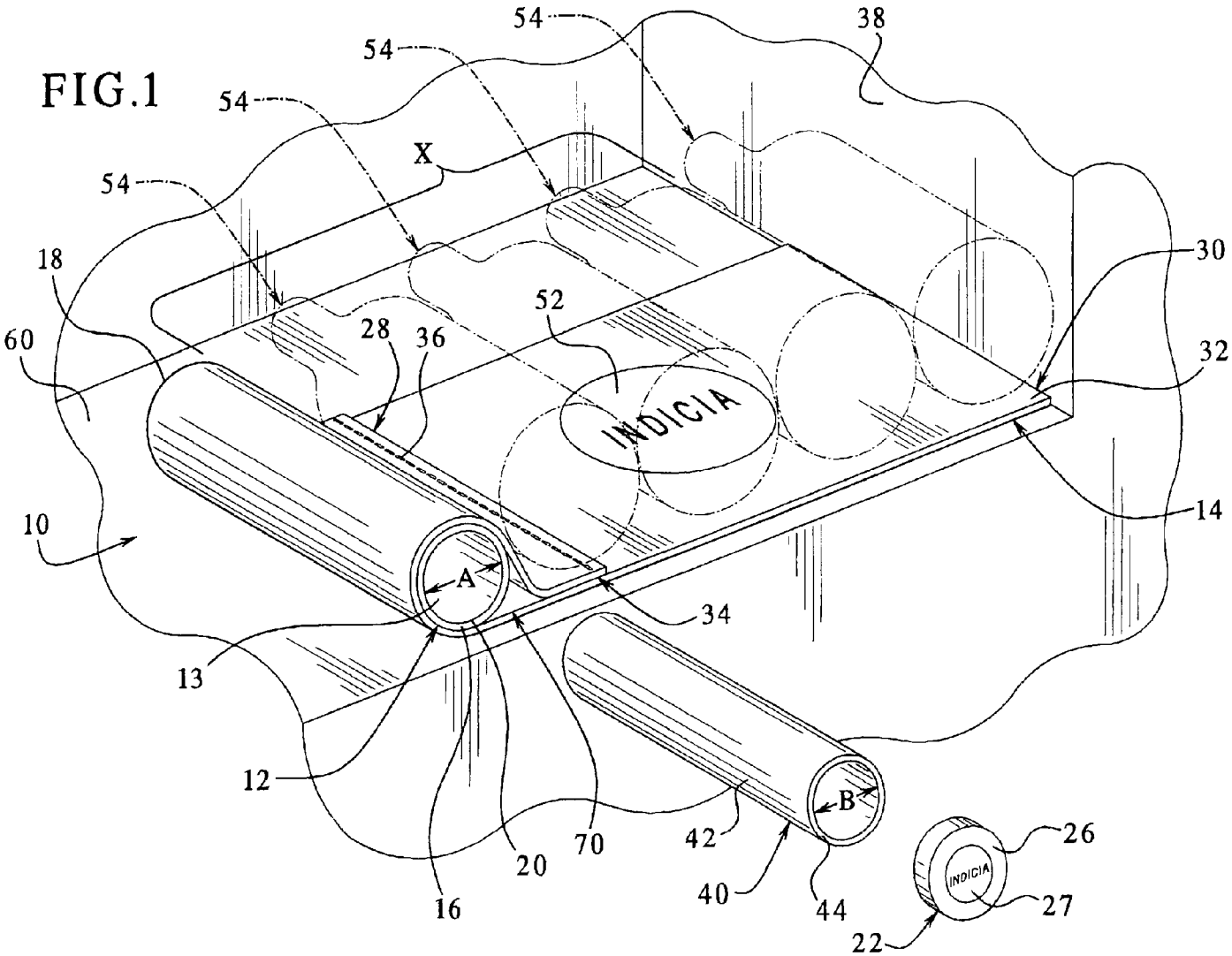
FIG. 1 illustrates an exploded view of an adjustable container holder in an embodiment of the present invention.

Referring now to the drawings wherein like numerals refer to like parts, FIG. 1 illustrates a container holder 10 in an embodiment of the present invention. The container holder 10 may have a holding stopper 12 attached to a base 14 and may be placed on a first surface 60. Further, the first surface 60 may be, for example, a counter, a cupboard, a shelf, a table and/or the like. The holding stopper 12 may be an object having peripheral walls 13 between a top end 16 and a bottom end 18. In a preferred embodiment, the holding stopper 12 is uniform between the top end 16 and the bottom end 18. The holding stopper 12 may be shaped as, for example, a tube, a box, a block, a cube, a triangle and/or the like. Further, the holding stopper 12 may be made of a material, such as, for example, steel, plastic, wood and/or the like. Still further, the holding stopper 12 may have a top opening 20 with a diameter A and a bottom opening (not shown in the drawings).

Moreover, a top cap 22 may attach to the holding stopper 12 and/or may cover the top opening 20. Additionally, a bottom cap (not shown in the drawings) may attach to the holding stopper 12 and/or may cover the bottom opening. In an alternative embodiment, the holding stopper 12 may be solid and/or may not have the top opening 20 at the top end 16 and/or the bottom opening at the bottom end 18. Further, the top cap 22 and/or the bottom cap of the holding stopper 12 may be shaped as, for example, a disk, a square, a rectangle and/or the like and may be constructed from a material such as, for example, steel, plastic, wood, paper and/or the like.

Still further, the top cap 22 may have an exterior face 26 and the bottom cap may have an exterior face (not shown in the drawings). The exterior face 26 of the top cap 22 and/or the exterior face of the bottom cap may display indicia 27. Further, the indicia 27 may be numerals, designs, insignias and/or words which relate to an entity, for example, advertising of a winery, brewery, a bottling company, a food processing company and/or the like.

The indicia 27 may be, for example, screened onto the exterior face 26 of the top cap 22 and/or the exterior face of the bottom cap. Further, the indicia 27 may be, for example printed onto the exterior face 26 of the top cap 22 and/or the exterior face of the bottom cap. Still further, the exterior face 26 of the top cap 22 and/or the exterior face of the bottom cap may be, for example, molded to contain the indicia 27. Moreover, the indicia 27 may be contained on, for example, a front side of a sticker having an adhesive backside which may be adhered to the exterior face 26 of the top cap 22 and/or the exterior face of the bottom cap.

Moreover, the base 14 may be shaped as, for example, a rectangular sheet having a first end 28, a second end 30 opposite to the first end 28 and a top side 32. It should be understood that the shape of the base 14 may be any shape such as, for example, a circle, a square, a triangle, an eclipse and/or the like. Further, the base 14 may be constructed from a material, such as, for example, a webbing, a fabric, a cloth, a paper, a plastic, a foam, a rubber, a polyurethane, a nylon, a meshing, and/or the like. Still further, a width (not shown in the drawings) of the base 14 may be less than a length (not shown in the drawings) of the peripheral walls 13 of the holding stopper 12.

Furthermore, the top side 32 of the base 14 may display indicia 52. The indicia 52 may be numerals, designs, insignias and/or words relating to an event such as, for example, a promotional festival, a concert tour, a celebration and/or the like. Further, the indicia 52 may be the same as the indicia 27. Still further, the indicia 52 may be applied to the top surface 32 of the base 14 by, such as, for example, screen painting, adhering a sticker displaying the indicia 52, printing, injection molding and/or the like.

As further illustrated in FIG. 1, the first end 28 of the base 14 may be looped around the holding stopper 12 and may be attached to the base 14 at an attaching position 34. Further, the first end 28 may be attached to the base 14 at the attaching position 34 by a stitching 36 which forms a hoop 70 of the first end 28. It should be understood that the first end 28 may be attached to the base 14 at the attaching position 34 by, for example, glueing, stapling, molding and/or the like. Still further, the holding stopper 12 may be inserted into the hoop 70 of the first end 28.

Moreover, the second end 30 of the base 14 may be placed near a second surface 38 and/or in contact with the second surface 38. The second surface 38 may be, for example, a wall, a cupboard, a surface of a refrigerator and/or the like. Further, the second surface 38 may be nonparallel with respect to the first surface 60. Still further, the container holder 10 may have a distance X between the holding stopper 12 and the second surface 38. Moreover, the container holder 10 having the distance X between the holding stopper 12 and the second surface 38 may accommodate, for example, four containers 54 in a row.

Figure 2:
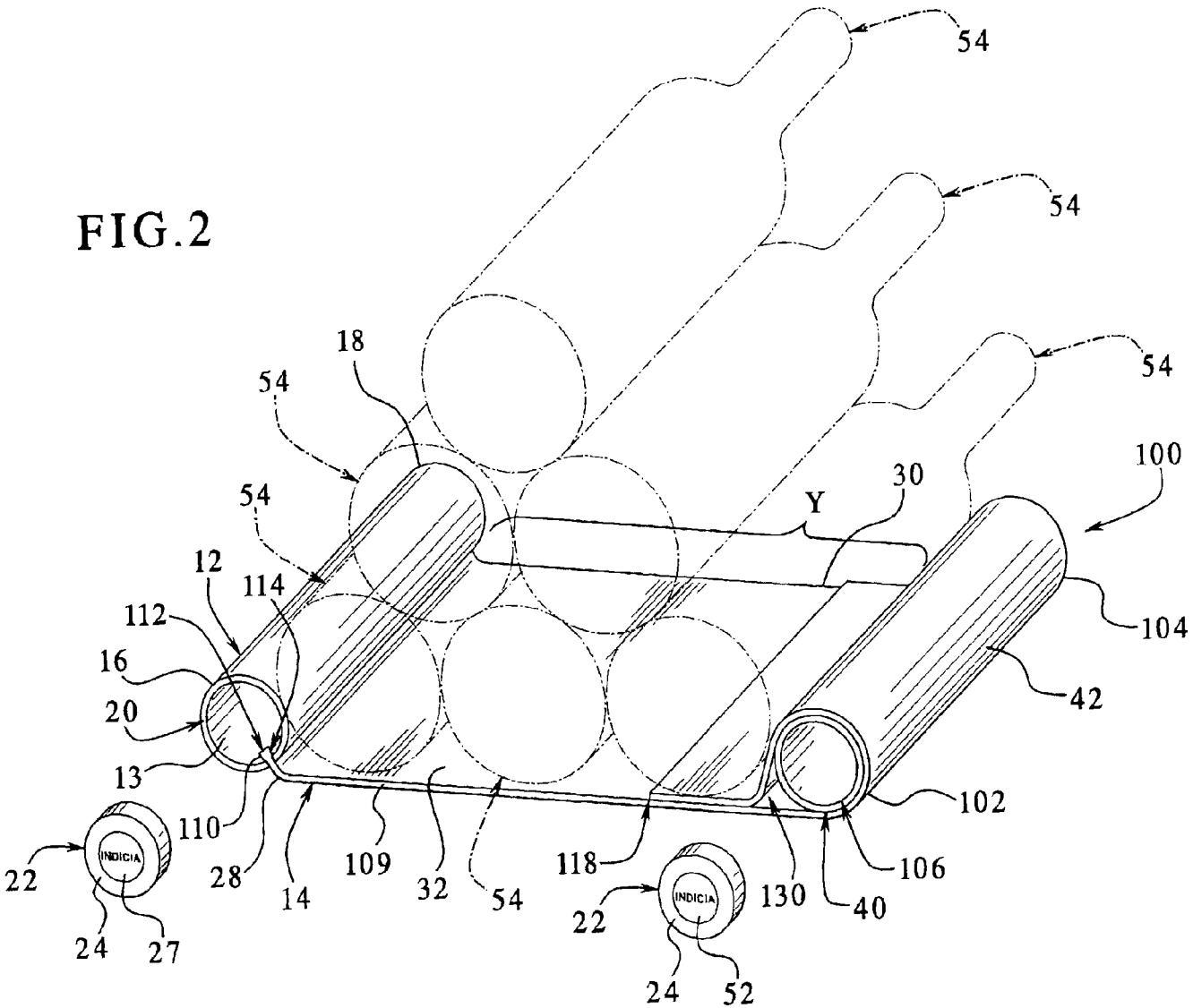
FIG. 2 illustrates an exploded view of an adjustable container holder in an embodiment of the present invention.
Figure 3:
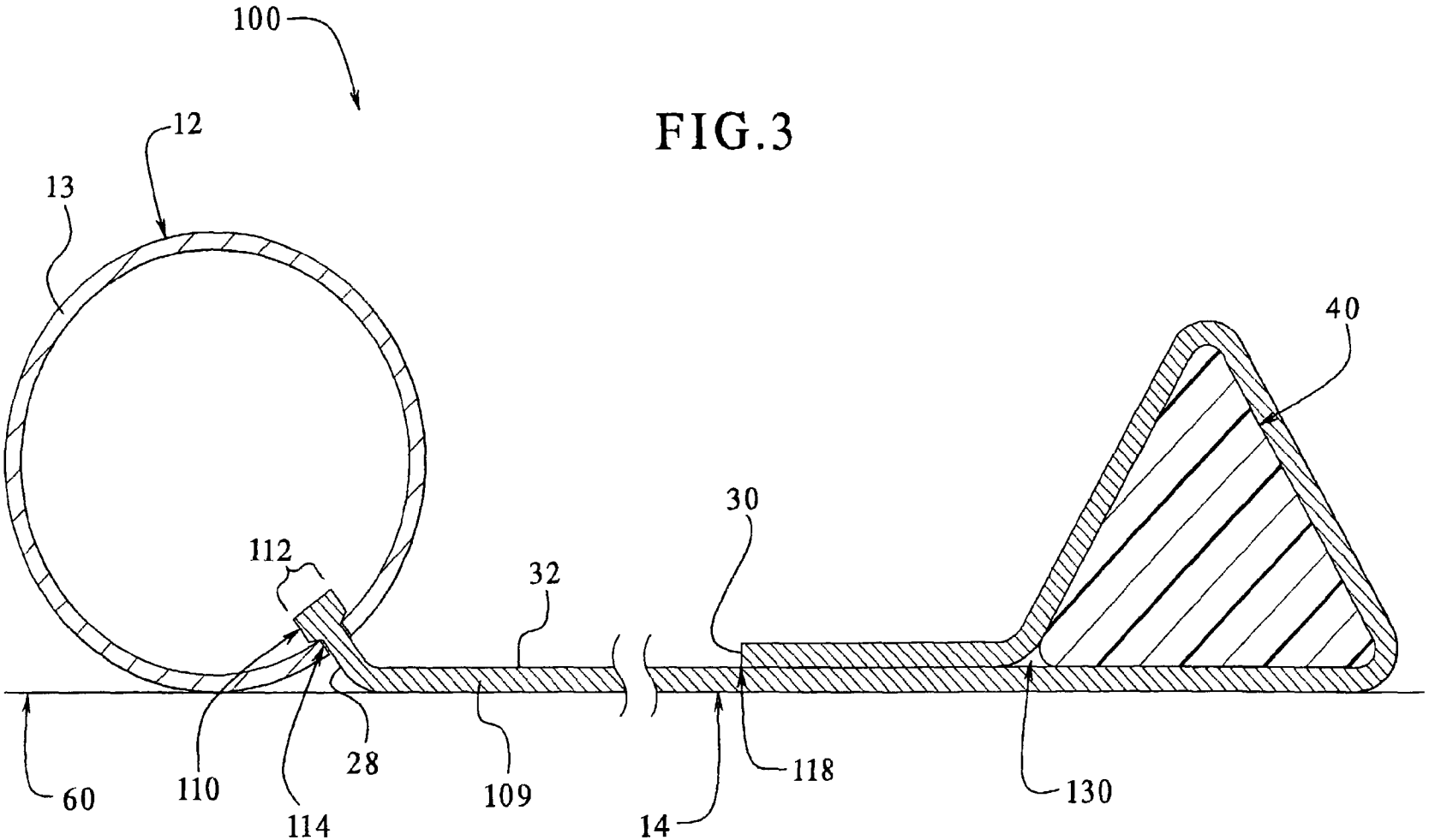
FIG. 3 illustrates a cross-sectional view of the adjustable container holder in FIG. 1 taken generally along line II-II in an embodiment of the present invention.
Figure 4:
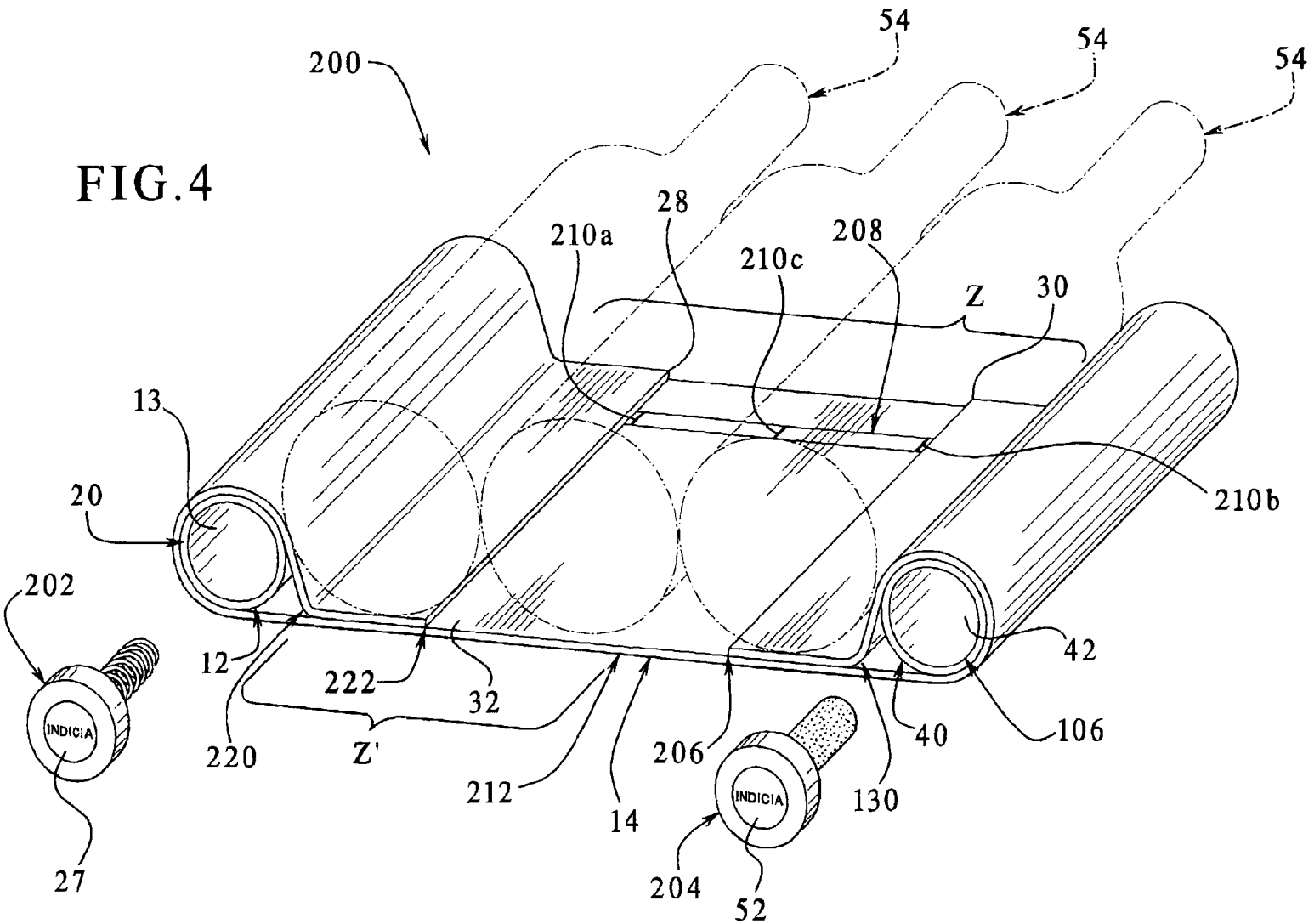
FIG. 4 illustrates an exploded view of an adjustable container holder in an embodiment of the present invention.

The container holder 10 may have a removable stopper 40 having a diameter B which may be inserted into the holding stopper 12 when the holding stopper 12 is coupled with the second surface 38 as illustrated in FIG. 1. The removable stopper 40 may be an object having peripheral walls 42 connected to a top end 44. In an alternative embodiment, the first end 28 of the base 14 may be attached to the holding stopper 12 and/or the second end 30 of the base 14 may be attached to the removable stopper 40 (as shown in FIGS. 2-4). Still further, the object may be shaped as, for example, a tube, a box, a block, a cube and/or the like. Moreover, the holding stopper 12 and the removable stopper 14 may have the same shape and/or may be the same size. In an alternative embodiment, the holding stopper 12 may be shaped differently than the removable stopper 14 and may be of a different size than the removable stopper 14 (not shown in the drawings).

Moreover, the removable stopper 40 may be inserted into the top opening 20 and/or held within the peripheral walls 14 of the holding stopper 12. The removable stopper 40 may be inserted into the hoop 70 of the first end 28 of the base 14. Further, the diameter A of the holding stopper 12 may be greater than the diameter B of the removable stopper 40. Still further, the holding stopper 12 may encompass the removable stopper 40 for storing. Moreover, the top cap 22 of the holding stopper 12 may cover the top opening 20 of the holding stopper 12 with the removable stopper 40 contained within the holding stopper 12.

Further, the containers 54 may be placed on the top surface 32 of the base 14 between the holding stopper 12 and the second surface 38. The containers 54 may be, for example, wine bottles, water bottles, cans of vegetables, cans of fruit and/or the like. The weight of the containers 54 on the top surface 32 of the base 14 may hold the holding stopper 12 in a fixed position with respect to the second surface 38 which maintains the distance X between the holding stopper 12 and the second surface 38. Moreover, the containers 54 may be held in a row between the holding stopper 12 and the second surface 38. Therefore, the container holder 10 having the distance X may accommodate, for example, four water bottles in a row.

FIG. 2 and FIG. 3 illustrate a container holder 100 in another embodiment of the present invention. The container holder 100 may have the holding stopper 12 connected to the removable stopper 40 with the base 14. The holding stopper 12 may be shaped differently than the removable element 40 (as shown in FIG. 3), such as, for example, a tube, a box, a cube, a triangle and/or the like. Further, the container holder 100 may be placed on the first surface 60. The top cap 22 may cover the top opening 20 at the top end 16 of the holding stopper 12. Further, the bottom cap may cover the bottom opening at the bottom end 18 of the holding stopper 12. Still further, the exterior face 24 of top cap 22 and/or the exterior face of the bottom cap may display the indicia 27 and/or the indicia 52.

Moreover, the removable stopper 40 may have the peripheral walls 42 between a top end 102 and a bottom end 104. In a preferred embodiment, the removable stopper 40 is uniform between the top end 102 and the bottom end 104. The top end 102 may have a top opening 106 and the bottom end 104 may have a bottom opening (not shown in the drawings). Further, the top cap 22 may cover the top opening 106 and have an exterior face 24 displaying the indicia 27 and/or the indicia 52. Still further, a bottom cap may attach to the bottom end 104 of the removable stopper 40 and may cover the bottom opening of the removable stopper 40. In an alternative embodiment, the removable stopper 40 may be solid and/or may not have the top opening 106 at the top end 102 and/or the bottom opening at the bottom end 104 (as shown in FIG. 3). The bottom cap may be shaped as, for example, a disk and may be made of materials, such as, for example, steel, plastic, wood, paper and/or the like. The diameter of the removable stopper 40 may be the same as the diameter of the holding stopper 12. Moreover, the bottom cap may display the indicia 27 and/or the indicia 52.

As further illustrated by FIG. 2 and FIG. 3, the base 14 having a height 109 may be connected to a fastener 110. It should be understood that first end 28 of the base 14 may be attached to the fastener 110 by, for example, glueing, stapling, clipping, crimping, molding and/or the like. Further, the fastener 110 may be shaped as, for example, a clip, a plug, a wedge, a hook and/or the like and may have a height 112. Still further, the fastener 110 may have a length (not shown in the drawings) different than the length (not shown in the drawings) of the peripheral walls 13 of the holding stopper 12.

Moreover, the holding stopper 12 may have a slit 114 in the peripheral walls 13. A length of the slit 114 may be different than the length of the peripheral walls 13 between the top end 16 and the bottom end 18 within the holding stopper 12. Further, the slit 114 may have a height which may be less than the height 112 of the fastener 110 and may be greater than the height 109 of the base 14. Further, the first end 28 of the base 14 may be inserted inside of the holding stopper 12. Moreover, the height 109 of the base may be less than the height 112 of the fastener 110.

Furthermore, the fastener 110 may be placed in the peripheral walls 13 of the holding stopper 12. The first end 28 may extend out through the slit 114 with respect to the peripheral walls 13. Moreover, the base 14 outside of the peripheral walls 13 may be pulled away from the slit 114 with respect to the holding stopper 12. The base 14 may be pulled away from the slit 114 with respect to the holding stopper 12 until the fastener 110 is positioned firmly against the peripheral walls 13 of the holding stopper 12. Further, the positioning of the fastener 110 firmly against the peripheral walls 13 may attach the base 14 to the holding stopper 12.

FIG. 2 and FIG. 3 illustrate the base 14 may extend away from the holding stopper 12 and be looped around the removable stopper 40 which forms a loop 130 with the second end 30 of the base 14. The second end 30 of the base 14 after looping around the removable stopper 40 may extend towards the holding stopper 12 overlapping the base 14 up to an adjustable position 118 on the top side 32 of the base 14. Additionally, the container holder 10 having a base length Y may be formed if the second end 30 of the base 14 is placed at the adjustable position 118 on the top side 32 of the base 14. Moreover, the removable stopper 40 may be removed from the loop 130 and replaced by the holding stopper 12.

Moreover, the containers 54 may be placed on the top side 32 of the base 14 between the holding stopper 12 and the removable stopper 40 of the container holder 100 having the base length Y. The weight of the containers 54 on the top surface 32 of the base 14 may hold the holding stopper 12 in a fixed position with respect to the removable stopper 40. Further, the containers 54 may be held between the holding stopper 12 and the removable stopper 40 which are in a fixed position with respect to each other. The container holder 100 having the base length Y may accommodate, for example, three containers 54 next to one another on a bottom row adjacent to the base 14. Still further, the container holder 100 having the base length Y may hold, for example, six containers 54 stacked in rows on top of each other forming, for example, a pyramid (as shown in FIG. 2).

FIG. 4 illustrates another embodiment of the present invention having a container holder 200 which may be placed on the first surface 60. Additionally, the container holder 200 may have the base 14 connecting the holding stopper 12 to the removable stopper 40. The holding stopper 12 may have the bottom cap covering the bottom opening. Further, the holding stopper 12 may have the exterior face of the bottom cap displaying the indicia 27 and/or the indicia 52. Further, the removable stopper 40 may have the bottom cap covering the bottom opening. Still further, the bottom cap may have the exterior face displaying the indicia 27 and/or the indicia 52. Moreover, the container holder 200 may have the removable holder 40 which may be inserted into the loop 130 of the base 14.

Furthermore, the container holder 200 may store and/or display the containers 54 which may be, for example, wine bottles. Additionally, the container holder 200 may have a cork screw 202 or other auxiliary device which may be constructed from a material, such as, for example, steel and/or the like. The cork screw 202 may be inserted into the top opening 20 of the holding stopper 12 and/or may be stored within the peripheral walls 13 of the holding stopper 12. Further, the cork screw 202 or other auxiliary device may be inserted into the opening 106 of the removable stopper 40. Still further, the cork screw 202 may be removed from the holding stopper 12 and may be used, for example, to open one of the containers 54, such as, for example, a wine bottle. Moreover, the cork screw 202 may display the indicia 27 and/or the indicia 52.

Further, the container holder 200 may have a plug 204 or other auxiliary device which may be constructed from a material, such as, for example, plastic, glass, cork and/or the like. Still further, the plug 204 may be inserted into the top opening 106 of the removable stopper 40 and/or may be stored within the peripheral walls 42 of the removable stopper 40. Moreover, the plug 204 or other auxiliary device may be inserted into the top opening 20 of the holding element 12. The plug 204 may be removed from the removable stopper 104 and may be used, for example, to close and/or seal one of the containers 54, such as, for example, a wine bottle. Furthermore, the plug 204 may display the indicia 27 and/or the indicia 52.

As further illustrated in FIG. 4, the base 14 may be looped around the holding stopper 12 which forms a loop 220 with the first end 28 of the base 14. The first end 28 of the base 14 after looping around the holding stopper 12 may extend towards the removable stopper 40 overlapping the base 14 up to an base position 222 on the top side 32 of the base 14.

Moreover, the holding stopper 12 may be removed from the loop 220 and replaced by the removable stopper 40.

Further, the container 200 may have the loop 130 around the removable stopper 40. The second end 30 of the base 14 may be looped around the removable stopper 40 and may extend towards the holding stopper 12 overlapping the base 14 at a first position 206 on the top side 32 of the base 14. Still further, the container holder 200 having a base length Z may be formed when the ends 28, 30 of the base 14 are placed at the positions 222, 206, respectively, on the top side 32 of the base 14.

Moreover, the base 14 may have a incremented scale 208 along the length of the top side 32. Further, the incremented scale 208 may have labeled positions 210. The base position 222 on the top side 32 of the base 14 may coincide with one of the labeled positions 210*a* on the incremented scale 208, such as, for example, zero. Still further, the first position 206 on the top side 32 of the base 14 may coincide with one of the labeled positions 210*b* on the incremented scale 208, such as, for example, six bottles of wine. By placing the second end 30 at one of the labeled positions 210, the length Z may be adjusted to accommodate the number of containers 54 indicated by the incremented scale 208. It is understood that the labeled positions 210 of the incremented scale 208 may coincide with any number, such as, for example, twenty-four of the containers 54, such as, for example, cans of vegetables. Still further, the placing of the second end 30 of the base 14 at the first position 206 may adjust a base length Z of the container holder 200 to accommodate, for example three containers 54 in a row and/or six containers 54, such as, for example, wine bottles stacked in the shape of, for example, a pyramid. Furthermore, the containers 54 may be placed on the top side 32 of the base 14 between the holding stopper 12 and the removable stopper 40 of the container holder 200 having the base length Z. The weight of the containers 54 on the top side 32 of the base 14 may hold the holding stopper 12 and the removable stopper 40 in a fixed position with respect to each other. The containers 54 may be held on the base 12 between the holding stopper 12 and the removable stopper 40. Moreover, the container holder 200 may store and/or display, for example, six wine bottles stacked on top of one another in the shape of, for example, a pyramid.

As further illustrated in FIG. 4, the container holder 200 may have a base length Z'. The container holder 200 having a base length Z' may be formed when the ends 28, 30 of the base 14 are placed at the positions 222, 212, respectively, on the top side 32 of the base 14. Additionally, the second position 212 on the top side 32 of the base 14 may coincide with the labeled positions 210*c* on the incremented scale 208, such as, for example, three bottles of wine. Further, the placing of the second end 30 of the base 14 at the second position 212 may change the base length Z to the base length Z' to accommodate, such as, for example, two containers 54, such as, for example, wine bottles in a row. Moreover, the container holder 200 having a base length Z' may hold, for example, three wine bottles stacked in the shape of, for example, a pyramid.

Figure 5:
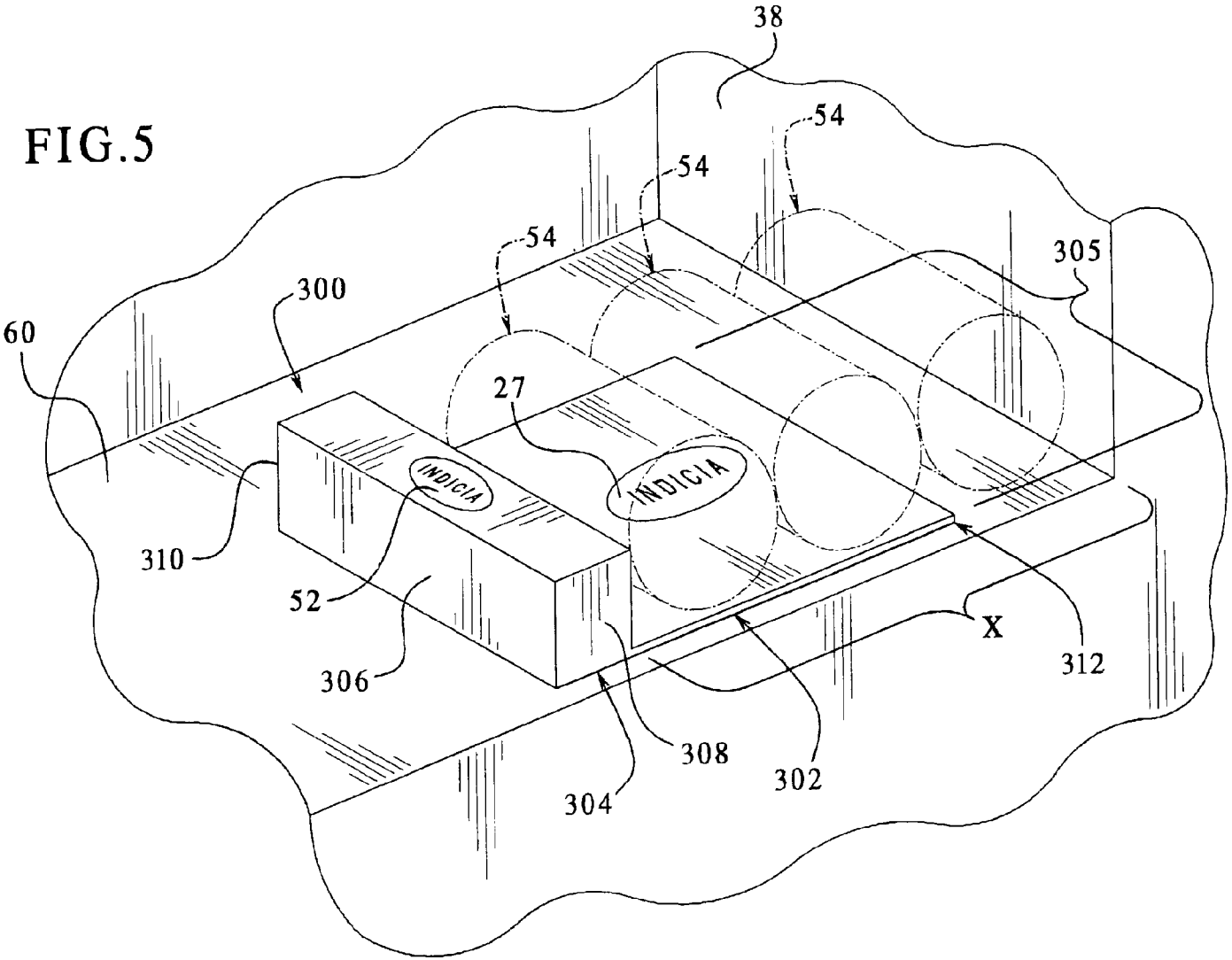
FIG. 5 illustrates an perspective view of an adjustable container holder in an embodiment of the present invention.

FIG. 5 illustrates a container holder 300 in another embodiment of the present invention which may be placed on the first surface 60. The container holder 300 may have a mat 302 having a stopper end 304, a holding end 312 opposite to the stopper end 304 and a width 305. The stopper end 304 may be an object having peripheral walls 306 between a top end 308 and a bottom end 310. Further, the stopper end 304 may be uniform between the top end 308 and the bottom end 310. Still further, the width 305 of the mat 302 may be less than a length of the peripheral walls 306 between the top end 308 and the bottom end 310 of the stopper end 304.

Moreover, the stopper end 304 may be shaped as, for example, a block, a tube, a cylinder, a box, a cube, a triangle and/or the like. The mat 302 may be shaped, such as, for example, a rectangular sheet. It should be understood that the shape of the mat 302 may be any shape such as, for example, a circle, a square, a triangle, an eclipse and/or the like. Further, the mat 302 having the stopper end 304 and the holding end 312 may be constructed from a material, such as, for example, a plastic, a foam, a rubber, a polyurethane, a wood and/or the like. Still further, the mat 302 having the stopper end 304 and the holding end 312 may be, for example, a single piece constructed by, for example, injection molding with a polyurethane material.

Furthermore, the top end 308 and/or the bottom end 310 of the stopper end 304 may display the indicia 27 and/or the indicia 52. Further, the mat 302 may display the indicia 27 and/or the indicia 52. Still further, the peripheral walls 306 of the stopper end 304 may display the indicia 27 and/or the indicia 52

As further illustrated in FIG. 5, the holding end 312 of the mat 302 may be placed near the second surface 38 and/or in contact with the second surface 38. The container holder 300 may have the distance X between the stopper end 304 and the second surface 38. Furthermore, the container holder 300 having the distance X between the stopper end 304 and the second surface 38 may accommodate, for example, four containers 54 in a row.

Moreover, the containers 54 may be placed on the top of the mat 302 between the stopper end 304 and the second surface 38. The containers 54 may be, for example, aluminum cans, wine bottles, water bottles and/or the like. The weight of the containers 54 on the mat 302 may hold the stopper end 304 in a fixed position with respect to the second surface 38 which maintains the distance X between the stopper end 304 and the second surface 38. Furthermore, the container holder 300 having the distance X may accommodate, for example, four tin cans.

Furthermore, the container holder 300 having the mat 302 and the second surface 38 may hold the containers 54. Moreover, the base length of the container holder 300 may be adjusted to hold a different number of the containers 54. The containers 54 may be placed on the mat 302 between the stopper end 304 and the second surface 38. Further, the weight of the containers 54 may hold the mat 302 in a fixed position with respect to the second surface 38 maintaining the distance X. Still further, the containers 54 may be held by the container holder 300 between the stopper end 304 and the second surface 38.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A container holder for supporting a plurality of containers wherein each of the plurality of containers has an axis of symmetry wherein each of the plurality of containers is generally cylindrical about the axis wherein the container holder is positioned on a surface, the container holder comprising:

a first stopper defined by peripheral walls wherein the first stopper has a length defined between a first end and a second end wherein the second end is located in a position opposite to the first end wherein the peripheral walls are generally symmetrical about an axis of symmetry of the first stopper wherein the axis of symmetry of the first stopper extends from the first end of the first stoper to the second end of the first stopper;

a base having a perimeter defining an exterior of the base wherein the perimeter is defined by a first end, a second end, a first edge and a second edge wherein the base has a height and a length wherein the length is defined between the first end of the base and the second end of the base and the height is defined between the first edge and the second edge wherein the base has a thickness defined between a top surface of the base and a bottom surface of the base wherein the bottom surface is opposite to the top surface wherein the height of the base is generally continuous and uniform between the first end of the base and the second end of the base wherein the length of the base is generally continuous and uniform between the first edge of the base and the second edge of the base wherein the thickness of the base is generally continuous and uniform between the top surface and the bottom surface from the first end of the base to the second end of the base and from the first edge of the base to the second edge of the base wherein the first stopper is secured to the first end of the base and further wherein the axis of symmetry of the first stopper is generally parallel to the axis of symmetry of each of the plurality of containers; and a support element adjacent to the surface wherein the second end of the base is connected to the support element wherein the base is only connected to the first stopper at the first end of the base and the support element at the second end of the base wherein the top surface of the base is generally planar between the first stopper and the support element wherein the top surface of the base is substantially parallel to the surface between the first stopper and the support element.

2. The container holder of claim 1 wherein the support element is a second stopper having peripheral walls between a first end and a second end.

3. The container holder of claim 1 further comprising:

stitching connecting the first end of the base to the first stopper.

4. The container holder of claim 1 further comprising:

a hoop at the first end of the base wherein the first stopper is inserted into the hoop.

5. The container holder of claim 1 wherein the support element is a nonparallel surface with respect to the surface.

6. The container holder of claim 1 wherein the base wraps around the support element.

7. The container holder of claim 1 further comprising:

a loop at the second end of the base wherein the support element is inserted into the loop.

8. The container holder of claim 1 wherein the length of the base is greater than the length of the first stopper.

9. The container holder of claim 1 further comprising:

a scale displayed on the top surface of the base wherein the scale is related to the plurality of containers.

10. The container holder of claim 1 further comprising:

an auxiliary device connected to the first stopper wherein the auxiliary device is a cork screw to open one of the plurality of containers.

* * * * *